United States Patent [19]

McNeill

[11] 3,938,952

[45] Feb. 17, 1976

[54] METHOD AND MEANS FOR MULTI-COLORED DYEING TEXTILE YARNS

[75] Inventor: William Allen McNeill, Gastonia, N.C.

[73] Assignee: Akzona Incorporated, Asheville, N.C.

[22] Filed: Aug. 20, 1974

[21] Appl. No.: 498,961

[52] U.S. Cl. ..... 8/149; 8/150; 68/10; 68/152; 68/199

[51] Int. Cl.[2] ..... D06F 17/02

[58] Field of Search ..... 8/149, 154, 155, 155.2, 8/150; 68/152, 156, 170, 175, 198, 199, 10

[56] References Cited

UNITED STATES PATENTS 3,459,012 8/1969 Renaud et al. ..... 68/199

*Primary Examiner*—Houston S. Bell, Jr.
*Attorney, Agent, or Firm*—Richards, Shefte & Pinckney

[57] ABSTRACT

A method and means for multi-color dyeing textile yarn wherein yarn is present in perforate cylindrical cans for dyeing, with the yarn being in a maze of tortuously extending coils progressing axially within the can as occurs when yarn is collected in an upright can from a crimping or bulking operation. The cans are first positioned on movable J-shaped cradles with their cylindrical axes horizontal and are then immersed sequentially in a plurality of dye baths in which the cans are only partially immersed. Between immersions in sequential dye baths the cans are reoriented by rotating them about their cylindrical horizontal axes to cause dyeing of at least partially different portions of the maze of yarn in the cans in the different dye baths so that the resulting yarn strand, which extends randomly in the maze throughout differently dyed portions, will be unpredictably randomly dyed in different colors and lengths of color.

27 Claims, 18 Drawing Figures

METHOD AND MEANS FOR MULTI-COLORED DYEING TEXTILE YARNS

BACKGROUND OF THE INVENTION

The present invention relates to dyeing of textile yarn and more particularly to dyeing textile yarn in multiple colors of unpredictably random distribution throughout the length of yarn.

The elimination of repeating patterns of multiple colors in dyeing textile yarn has long been sought to satisfy the popular demand for randomly colored fabric for garments and especially for carpets. The common commercial means for accomplishing this include, inter alia, dripping dye on travelling yarn strands, and intermittently bringing sections of travelling yarn strands into contact with printing rolls. These systems require complicated and expensive applicator equipment, as well as sophisticated control devices, such as electronic program units, to effect anything approaching pure random dye application. Also, these systems require the additional cost and operational problems of winding equipment for collecting the yarn from the system. On the other hand, dyeing of yarn in batches in the form it is collected from other processing operations, such as in cans or skeins, has not heretofore been commercially adapted to produce truly random dyeing. Skeins, for example, may be dyed in multiple colors by immersing different portions in different colors, but because of the uniform distribution of the yarn in the skein and the relatively short length of yarn in each winding of a skein the resulting yarn has relatively short uniform lengths of different colors in an easily detectible repeating pattern.

By the present invention, however, yarn may be economically and effectively used in the form it is collected in a preceding processing operation and it is dyed inexpensively and simply in multiple colors in a manner that uniquely results in an unpredictably random distribution of colors and color lengths in the ultimate yarn strand.

SUMMARY OF THE INVENTION

Briefly described, the present invention comprises a method and means for progressively advancing a batch of textile yarn in a perforate container through the steps of positioning the container to have a horizontally disposed axis, immersing the positioned container sequentially in each of a plurality of dye baths with the immersion in at least one of two sequential dye baths being to a depth less than the full extent of the batch of yarn in the container so as to have dye applied to only a portion of the batch, while disposing the container in a different dyeing disposition in each of the two dye baths with the axis maintained horizontally disposed. Preferably, the yarn is disposed in the container in a tortuously coiled maze that progresses axially along the aforesaid axis that is positioned horizontally so that the yarn extends randomly into and out of the portion dyed in the less than full immersion dyeing step; and, preferably, the aforesaid different dyeing disposition in the dye baths is obtained by reorienting the container about the aforesaid horizontal axis between immersions in the two sequential dye baths to cause dyeing of at least partially different portions of the batch in the two dye baths.

In the preferred embodiment of the present invention, the container is a cylindrical can that has been filled with yarn in a preceeding crimping or bulking operation and is then disposed with its cylindrical axis horizontal, with the can being rotated about its cylindrical horizontal axis. As a specific example, the can may be immersed in each of three dye baths to the level of the horizontal axis and rotated one-third of a revolution between each of the three dye baths to produce six differently colored segments through which the yarn randomly meanders, three of the segments being color blends resulting from overlapping of segments being dyed in the different dye baths.

DESCRIPTION OF THE PREFERRED EMBODIMENTS

Figure 1:
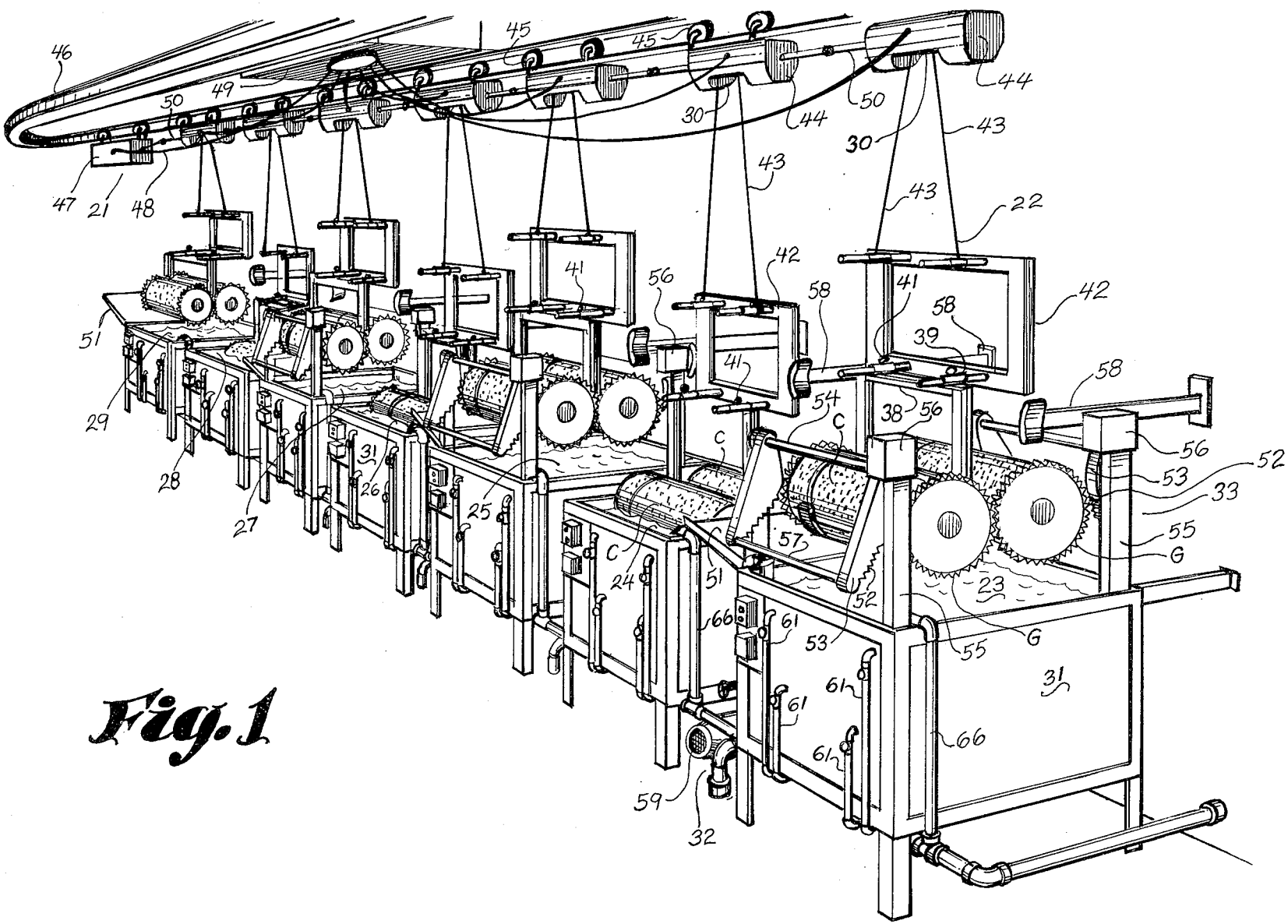
FIG. 1 is a perspective view of a dyeing line incorporating the preferred embodiment of the present invention.
Figure 2:
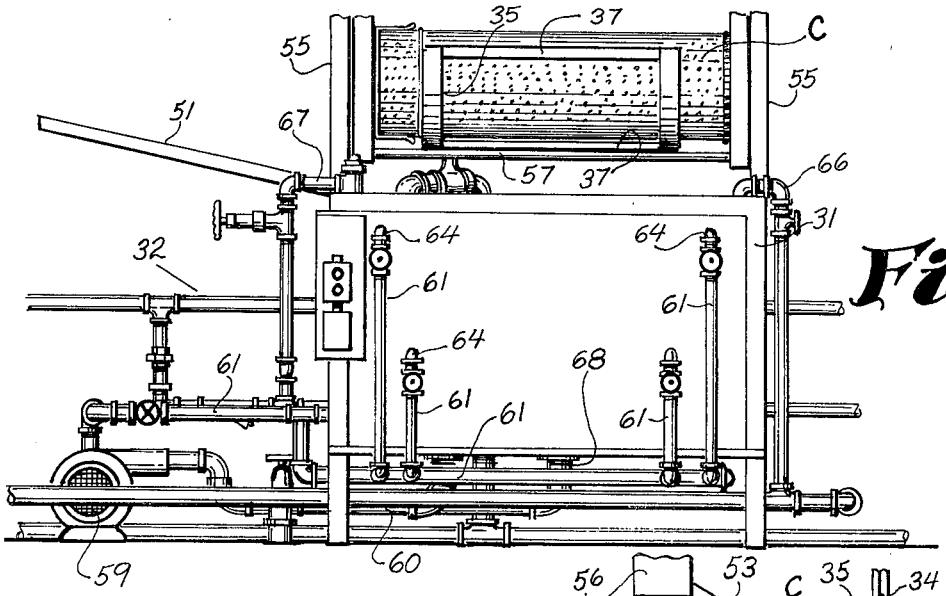
FIG. 2 is a front elevation of one dyeing station of the dyeing line of FIG. 1.
Figure 3:
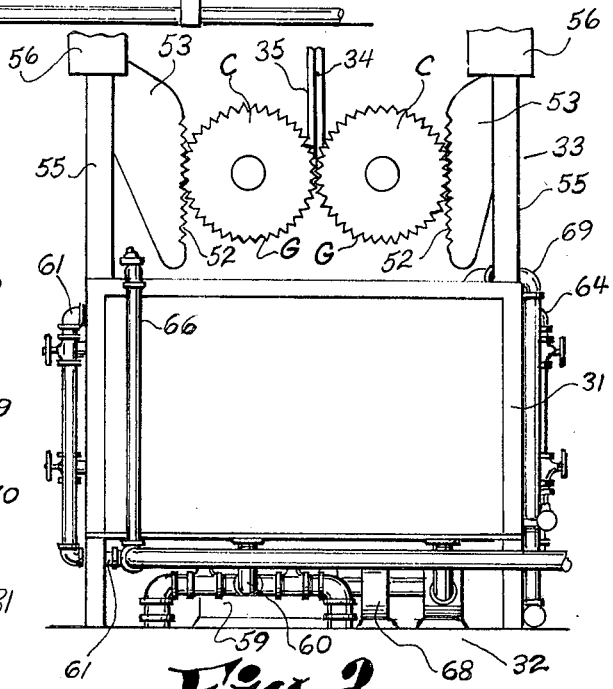
FIG. 3 is a side elevation of the dyeing station of FIG. 2 with the yarn containing cans in a raised position.
Figure 4:
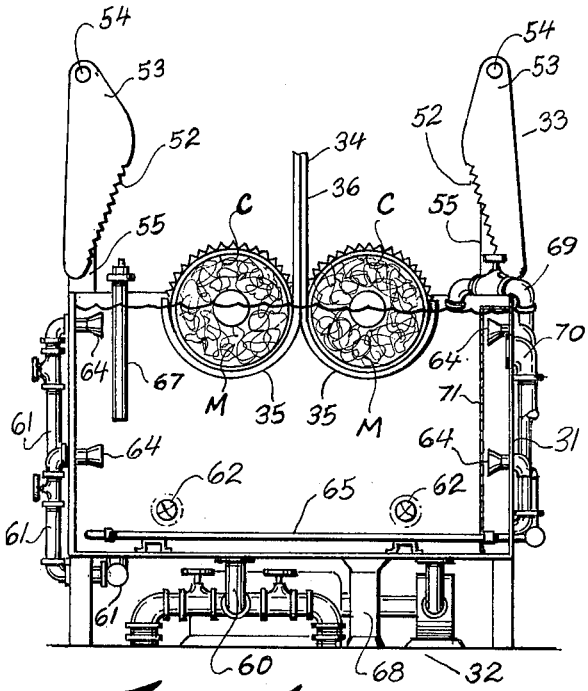
FIG. 4 is a vertical sectional view taken along line 4—4 of FIG. 2.
Figure 5:
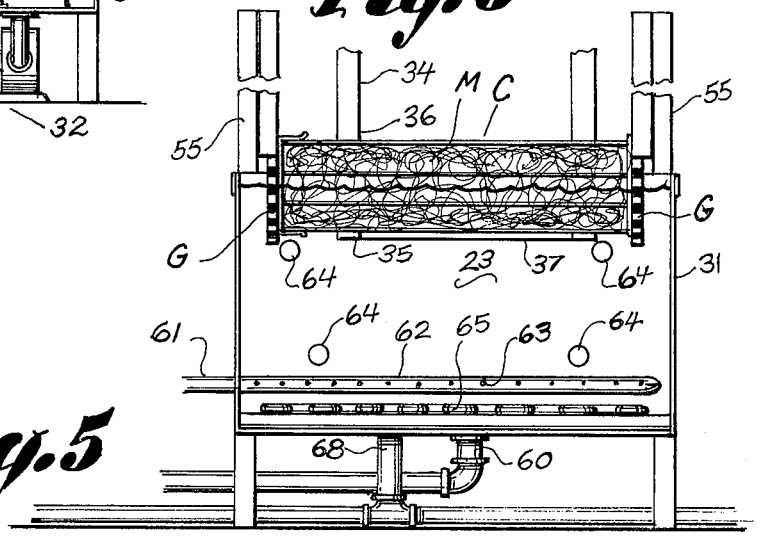
FIG. 5 is a vertical sectional view taken along line 5—5 of FIG. 4.
Figure 6:
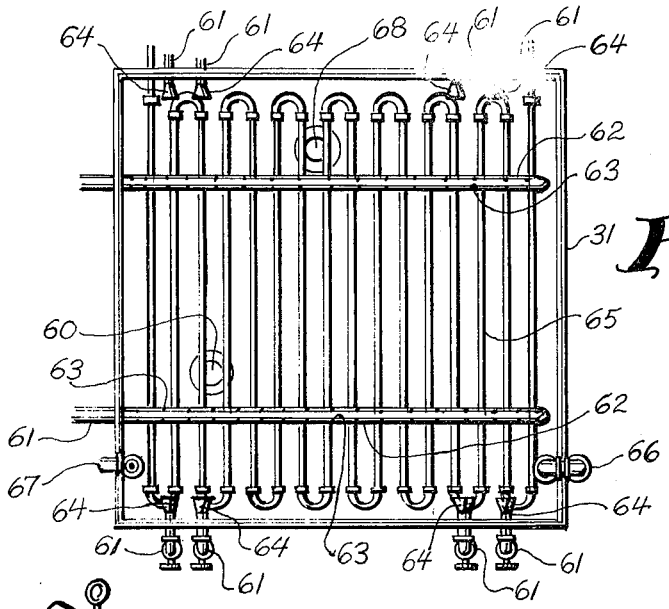
FIG. 6 is a plan view of the dye tub shown in FIGS. 1–5.

In the preferred embodiment illustrated in FIGS. 1–6, the method of multi-color dyeing textile yarn of the present invention is incorporated in an automated dyeing line 20 wherein perforate cans C are progressed sequentially through a series of dyeing and rinsing treatments. This dyeing line 20 includes a ceiling-mounted automated transporting system 21 that transports the cans C from treatment station to treatment station on movable support means 22 on which the cans C are supported for lowering into and raising from dye baths 23, 25, 27 and rinse baths 24, 26, 28, and 29 by means, such as a conventional hoist mechanism 30, incorporated in the transport system 21. The treatment baths in which the cans C are immersed in this operation are contained in tubs 31 with each of which is associated means for circulating the dye or rinse liquid therein. Also, means 33 are provided for disposing the cans in different dyeing dispositions in the different dye baths while maintaining the axes of the cans horizontal. In the preferred embodiment this means for differently disposing the cans functions to reorient the cans about the horizontal axis by rotation to dispose at least partially different portions of the maze M of yarn in the cans C to dyeing in the different dye baths 23, 25 and 27.

In the illustrated embodiment, the cans C are of a conventional type used to collect yarn from a crimping or bulking operation, an example of which is disclosed in my copending U.S. patent application Ser. No. 310,476, filed Nov. 29, 1972, as a continuation-in-part of my earlier U.S. patent application Ser. No. 169,007, filed Aug. 4, 1971. These cans C are perforated to allow fluid flow therethrough when yarns are being processed therein as in a subsequent steaming or autoclaving operation and in the present instance the perforations permit flow of dye liquor and rinse water freely therethrough for full treatment of the yarn in the can in the operation of the present invention, resulting in the simple and economical usage of the collection state of the yarn from the preceding processing in the dyeing operation of the present invention without having to wind or otherwise additionally handle the yarn before and after running it through the operation of the present invention.

Figure 9:
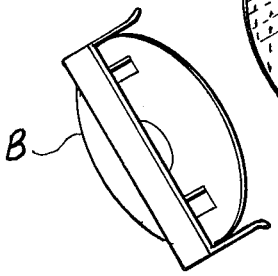
FIGS. 9 *a*, *b*, and *c* are vertical sectional views of the sequential immersion of the yarn in a can in sequential dye baths.
Figure 9:
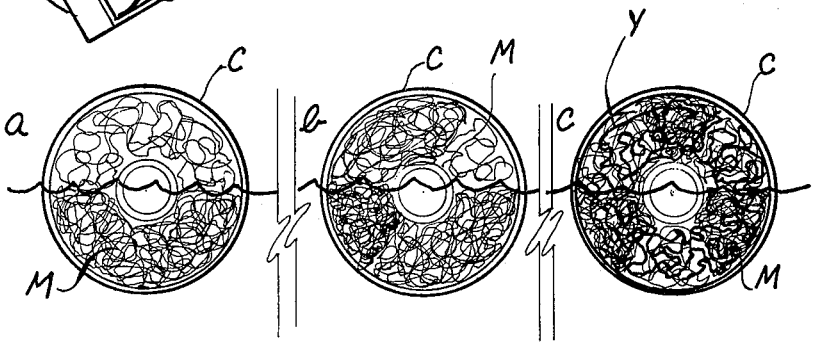

The yarn collected in the cans C at the end of the preceding crimping or bulking operation, as disclosed in the aforesaid copending application, is randomly distributed in the form of a tortuously coiled maze M (FIG. 9) resulting from the rotation of the can about its vertical cylindrical axis as the crimped and bulked yarn is allowed to coil therein in a generally circumferentially progressing coiling while the yarn is also moving back and forth haphazardly during the general coiling progression, and as the can is upright with its axis vertical the progression of the maze M is in the axial direction as well as progressing circularly about the cylindrical axis.

Figure 8:
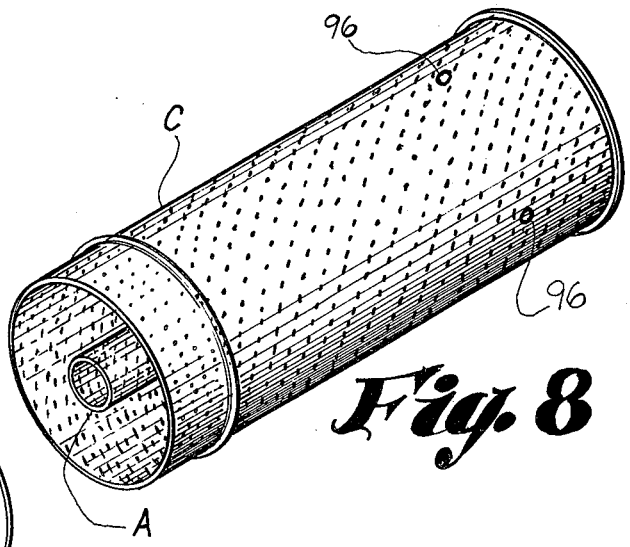
FIG. 8 is an exploded view of a can and its cover as used on the cradle of FIG. 7.

To facilitate dye liquor and rinse water flow through the can C a perforate center core A is mounted centrally therein prior to filling of the can C with yarn and the maze M of yarn is retained in the can C during the treatment of the present invention by a cover B that fits over the open end of the can C, as shown in FIG. 8 for use in a latter described variation of the presently described embodiment.

The filled cans C are mounted for progression through the dyeing operations of the present invention with their cylindrical axes, which were in a vertical disposition during filling, in a horizontal disposition with the maze M of yarn progressing generally horizontally in coils that extend tortuously and generally circularly around the horizontally disposed axes. This horizontal disposition is obtained by support of the cans C in cradles 34 of generally J-shape, with each cradle 34 having two J-shaped portions 35 in back-to-back disposition to support two cans C in parallel relation at the same level for common simultaneous treatment through the system. These J-shaped portions 35 each consist of two spaced legs with cross supports 37 and top cross plates 38 to which are secured a pair of horizontally extending mounting sleeves 39 that slide on horizontal support rods 40 of the movable support means 22, to which rods 40 the sleeves 39 are secured by set screws 41 to fix the position of the cradles 34 on the rods 40 in proper disposition for can positioning in progressing through the various treatment stages. The support rods 40 project laterally from a frame 42 of the movable support means 22, which frame is suspended by cables 43 from the aforementioned hoist mechanisms 30 that function to raise and lower the frame 42 and supported cans C.

The hoist mechanisms 30 are mounted on trolleys 44 suspended from rollers 45 that ride on an overhead closed track 46 on which the hoist mechanisms 30 and attached support means 22 are guided to advance the cans C past the various dye baths 23, 25, 27 and rinse baths 24, 26, 28, and 29. The trolleys 44 are drawn around the track 46 by a tractor 47 that rides on top of the track 46 and is driven therearound by a motor therein that rotates a gear (not shown) in engagement with a fixed chain in the track 46 in a conventional manner. This tractor 47 is connected through an electrical cable 48 to a main power source 49 in the center of the track area, and is connected to the first trolley, with all the trolleys sequentially connected similarly, by identical connecting rods 50 that are centrally pivoted to accommodate movement of the trolleys 44 around the curves of the track 46 at spacings equivalent to the spaces between treatment baths.

A series of limit switches (not shown) are disposed about the track 47 at spacings located to be engaged by the tractor 47 when the cans C are at each sequential dye bath and rinse bath station. Engagement of these limit switches stops the drive of the tractor and initiates a timer that actuates the hoist mechanisms 30 to lower the cans C for dyeing immersion, allow a dwell period at the lowered position, raise the cans, and then again actuate the tractor 74 to move the train of trolleys 44 to the next bath position where the sequence is repeated by the tractor 47 engaging the next limit switch. The limit switch controls, timer, and electrical operating devices are all of conventional construction and operation and are, therefore, not disclosed in detail herein.

In progressing through the dyeing line 20, at the first dye bath 23 the can C is lowered into the bath without reorientation or manipulation in the cradles 34 and the maze M of yarn in the can C is dyed to the center line as a result of this immersion, which is to a depth less than the full extent of the batch or maze of yarn in the can. (FIG. 9a).

When the cans C are raised by the hoist mechanism 30 they are allowed to drain into the dye bath, and as they move down the line any further dripping of dye liquor from the cans C will be caught by an inclined drip pan 51 that extends between adjacent dye baths at an inclination back toward the respective dye baths from which the cans C have just been removed to drain the dripped dye liquor back into the dye baths.

At the first rinse bath 24, cans that have been previously immersed in the adjacent first rinse bath 24 are immersed for the purpose of rinsing residual dye liquor from the maze M of yarn before proceeding to the second dye bath 25, at which the cans C are immersed in the second dye bath 25 with the cans C disposed in different dyeing dispositions than in the first dye bath 23, but with the axes maintained horizontally disposed.

In the illustrated embodiment the means 33 for disposing the cans in different dyeing dispositions functions to reorient the cans C about their horizontal axes and in particular to rotate the cans C about these horizontal axes to dispose at least a portion of the previously undyed maze M below the level of the horizontal axis and a corresponding diametrically opposite previously dyed portion above the level of the can axis. Thus, when immersed in the second dye bath 26 the aforementioned portion of previously undyed material will take on the color of the second dye bath 26 and the previously dyed portion that is below the level of the axis of the can C will be a color that is a blend of the dyes in the first and second dye baths.

Reorientation or rotation of the cans C about their horizontal axes is accomplished by forming the cans C with gear sections G at the original bottom end of the cans C and at the original top end, i.e., the cover B. These gears G are arranged to mesh with teeth 52 of pivoted racks 53 supported above the tub 31 on each side thereof with the racks 53 secured to pivot shafts 54 mounted on upstanding posts 55 at the corners of the tub 31. Mounted on one post 55 at each side of the tub 31 is a housing 56 containing a conventional drive motor (not shown) operated by the timer to pivot the racks 53 into and out of position for engagement with the gears G on the cans C. When the cans C are being lowered into the second dye bath 25 the racks 53 are in their inward operative position for engagement of the gears G of the cans C as the cans progress downwardly. This engagement causes rotation of the cans C, whose gears G intermesh to facilitate simultaneous opposite rotation under the rack and gear engagement, and with the cans rotationally sliding in the J-shaped portions 35 of the cradle 34. The teeth 52 on the racks 53 are related to the teeth in the gears G so that upon each downward movement of the cans C they will be rotated one-third of a revolution, but this can be varied as desired for different dyeing purposes. Also, to assure proper alignment of the gears G with the racks 53 for operable engagement, pairs of guide arms 58 are secured to the adjacent wall and project into alignment with opposite ends of the frame 42 at each dye bath position below and out of interference with the frame as it moves between baths but in position for engagement therewith upon lowering, thereby stabilizing the frame 42 and supported can C in position for gear and rack engagement.

Prior to the cans C being raised, the racks 53 are pivoted by the shafts 54 to an outward inoperative position so that the cans C can be raised therepast without any rotational engagement and the cans can, therefore, drip with the dyed portion down without bleeding into adjacent undyed or differently dyed portions.

An identical rack 53 arrangement is disposed at the third dye bath 27 for rotation of the cans C another one-third revolution between immersion in the second dye bath 25 and third dye bath 27 following a rinse in the second rinse bath 26. However, no means for changing the dyeing can disposition is needed at the first dye bath 23 and the four rinse baths 24, 26, 28, and 29; but for purposes of clarity of illustration of the rack arrangement, an arrangement is shown at the first dye bath 23.

The fourth rinse bath 29, which follows the aforementioned third rinse bath 28 without any dyeing operation inbetween, is provided in the event further treatment is desired or if further rinsing is required to remove any remaining excess dye.

Although for purposes of illustration only the movable support means 22 that lowers and raises the cans C into the baths are shown supporting the cans C at different levels, it should be understood that preferably all of the movable support means 22 will be at the same level so that all of the cans will be simultaneously in the same stage of either dyeing or rinsing while the mazes M or batches of yarn in the separate cans C will be progressively advancing through the various treatment stages.

Circulation of the dye liquor in the tubs 31 to obtain rapid and uniform dye penetration in the maze M of yarn in the cans C is obtained by a pump 59 adjacent each tub 31. The input of each pump 59 is connected by a drain pipe 60 to the bottom of the associated tub 31 so that dye liquor is drawn from the tub 31 at the bottom thereof into the pump 59 from which it is directed to the tub through recirculating pipes 61 connected to two tubes 62 that extend horizontally and parallel across the bottom of the tub 31. These tubes 62 have rows of holes 63 disposed at 45° from horizontal for input of dye liquor recirculation into the tub 31, which is accomplished at relatively high pressure. Dye liquor is also introduced to the tub 31 at the front and rear walls thereof through pairs of nozzles 64 also connected to the recirculating pipes 61. These pairs of nozzles 64 are alternately operable by valve control depending upon the level of dye liquor in the tub 31.

The dye liquor is maintained at a selected level for proper immersion by manual periodic filling through a water input pipe 67 and is maintained at a desired temperature by steam coils 65 that serpentine along the inside bottom of the tubs 31 below the recirculating tubes 62. The concentration of the dye to obtain the proper shade or color during removal of the dye by the yarn is controlled manually by an observer who simply adds dye concentrate periodically as necessary.

To fill the tubs 31 initially in preparation for dyeing, locally available water is introduced through the water input pipes 65 and the water is heated by the introduction of steam through a steam input pipe 67. Dye concentrate is added manually and when the proper level and concentration of dye liquor is obtained the pump 59 is relied upon to maintain circulation. At the end of a run the dye liquor in the tubs 31 is removed through a drain pipe 68 connecting the bottoms of the tubs 31 to a sewer drain; and with the recirculation system and the compact immersion of cans C in the tubs 31, relatively small tubs can be used with a minimum of dye liquor for economical operation without significant end-of-run waste of dye liquor.

The rinse baths 24, 26, 28, and 29 utilize the same type of tubs 31 and may include the same plumbing for recirculating rinse water. In addition, the rinse baths are further provided with a pure water input pipe 69 and an elevated drain 70 in the rear wall protected by a screen 71 from clogging or blockage by material such as yarn when the equipment may be used alternatively for skein dyeing. The pure water input pipe 69, elevated drain 70, and screen 71, all of which are needed only for the rinse baths, are shown for simplicity of illustration incorporated also in a dye bath tub in FIG. 4, and when so utilized it renders the tub 31 adaptable for use either for dyeing or rinsing.

For purposes of illustration in FIG. 1 a complete circuit of trolleys 44 is not shown, the figure showing only those trolleys that are located at the various dye and rinse baths. In actual practice there would be a continuous series of trolleys 44 with unloading stations following the fourth rinse bath 29 and loading stations preceding the first dye bath 23 so that a continuous operation can progress with the yarn being handled in batches in the form of the mazes M of yarn in the cans C. During this continuous operation each can is first immersed in the first dye bath 23 to the level of the horizontal cylindrical axis at which the lower half of the maze M of yarn in the can C is dyed to the color of the dye in the first dye bath. The can C is then immersed in the first rinse bath 24 to remove the excess dye remaining from the first dye bath 23. The cans C are then advanced to the second dye bath 25 and as they are lowered thereto they are engaged by the racks 53 intermeshing with the gears G to rotate the cans one-third of a revolution, thereby raising two-thirds of the previously dyed portion of the maze M above the horizontal level of the axis, leaving one-third of the previously dyed portion below the dyeing level, and lowering below this dyeing level two-thirds of the previously undyed portion. This one-third dyed portion and two-thirds undyed portion below the dyeing level is then immersed in the second dye bath 25 to the horizontal level of the cylindrical axis to overdye the one-third previously dyed portion, thereby giving a blend or changed color to that portion, while giving the previously undyed portion the color of the second dye bath 25. The can C is then raised from the second dye bath 25 and rinsed in the second rinse bath 26. It is then advanced to the third dye bath 27 wherein it is lowered and again rotated in the same direction one-third of a revolution by the rack 53 engagement with the gears G, which raises above the dyeing level both the overdyed portion as well as half of the portion originally dyed only in the second bath, and lowers below the dyeing level the only remaining undyed segment, half of the segment dyed only in the first dye bath and leaves below this level half of the segment dyed only in the second dye bath. Following this dyeing in the third dye bath 27 the can C is immersed either fully or half way with rotation between, in the third rinse bath 28 and again in the fourth rinse bath 29 to fully rinse the maze M of yarn in the can C for a double dye bath immersion period to fully remove all excess dye. The dyed maze M is then transported while still in the same can C through conventional steaming or autoclaving to set the yarn shape and to fast the color tone.

Figure 11:
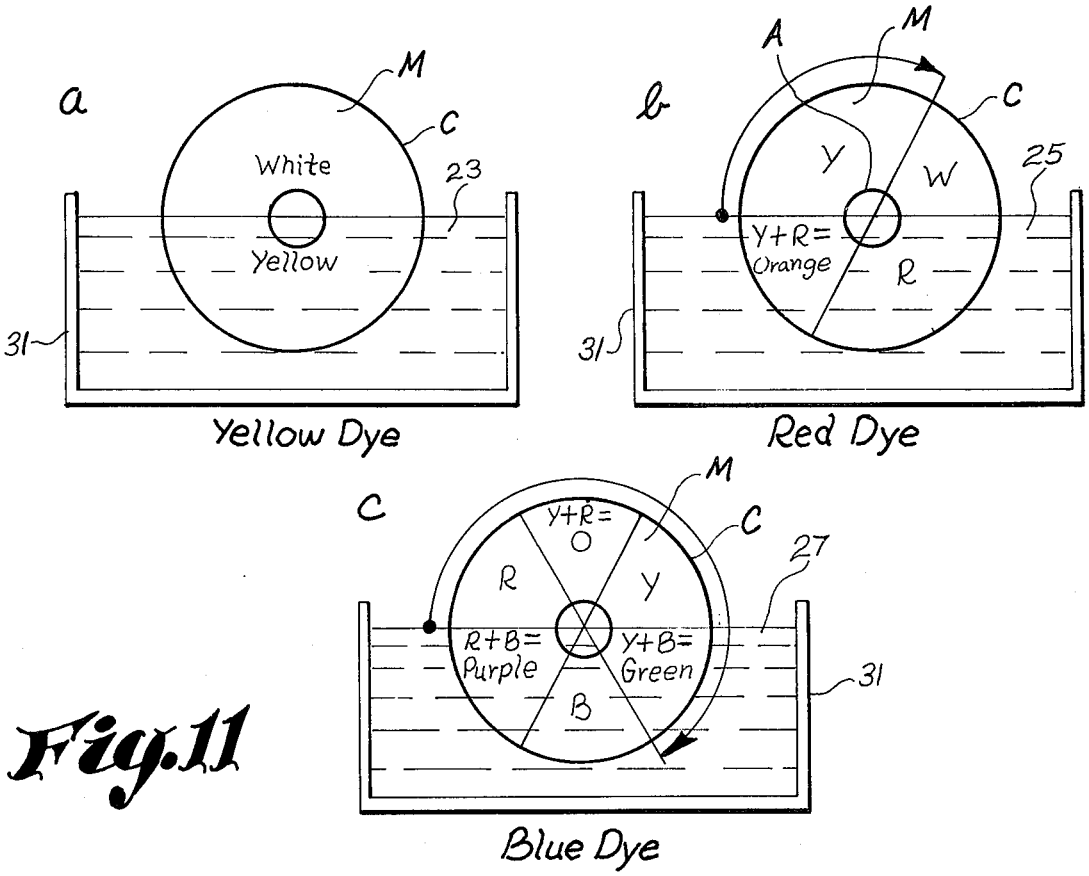
FIGS. 11 *a*, *b*, and *c* are diagrammatic illustrations of a particular sequence of dyeing immersion obtained with the lines of the preceding variations.

The result of the dyeing operation described heretofore is illustrated diagramatically in FIGS. 11 *a*, *b*, and *c*. In FIG. 11*a* the can C is seen immersed half-way in yellow dye, which dyes the lower half of the maze M of yarn with the upper half remaining undyed or white. Red dye is used in the second dye bath as shown in FIG. 11*b*, but before the can C is immersed it is rotated one-third revolution or 120°, by the rack 53 and gear G engagement, which rotates 120° (or ⅔) of the yellow (Y) dyed maze M above the immersion level, leaves 60° of yellow dyed maze M below the immersion level and lowers 120° of previously undyed white maze M below the immersion level, leaving 60° of previously undyed white (W) maze M above the immersion level. When the can C is then immersed half-way in the red dye second bath 25, the 120° previously undyed portion will take on the red color (R) and the 60° previously dyed yellow portion will be overlapped by red dye and be blended therewith to become orange (O).

Following immersion in the second dye bath 25 the can C is immersed in the second rinse bath 26 and then advanced to the third dye bath 27, before which it is again rotated 120° in the same direction as the previous rotation to dispose 60° of yellow (Y), 60° of orange (O), and 60° of red (R) above the immersion level and dispose 60° of red, 60° of undyed white, and 60° of yellow below the immersion level. Thus, when the can C is lowered half-way into the third dye bath (FIG. 11*c*), which contains blue dye, the immersed yellow portion will combine with the blue to produce green (G), the previously undyed or white portion will become blue (B), and the previously dyed or red portion will combine with the blue to produce purple (P).

Following immersion in the third dye bath 27 the can C will be immersed sequentially in the third rinse bath 28 and the fourth rinse bath 29 and the final dyed maze M will have thereby been divided into 60° or one-sixth revolution segments of sequential red (R), orange (O), yellow (Y), green (G), blue (B), and purple (P) colors.

Although the dyeing procedure as described hereinabove results in dyeing of six equal segments of the maze M of yarn in the can C, there is no uniformity of the length of the individual strand of yarn dyed in each color nor any uniformity of color change. The maze M, which is not shown in the diagrammatic views of FIGS. 11 *a*, *b*, and *c*, is shown in corresponding FIGS. 9 *a*, *b*, and *c* wherein a length of yarn Y of the maze M is shown in dark line to indicate the coiled and tortuous disposition of the yarn in a generally circularly progressing coil that curls and coils back and forth unpredictably across different color sections with different lengths of yarn in the different color sections. As a result, the yarn Y randomly extends from one differently colored portion into another and the dyeing is completely random and totally unpredictable or non-repeatable so that a fabric made from the yarn will show no evidence of a pattern and will have a truly random color mix with some color lengths being of considerable length and others being relatively short.

The number of different color dye baths and the extent of reorientation between dye baths may be varied from two to as many as may be selected to obtain desired effects, with at least one dye bath immersion being less than the full depth of the can C to assure different dyeing effects, and with the dye baths arranged with progressively darker colors or shades in sequence. Also, the level of immersion of the cans C in the various dye baths can be varied for special effects with or without rotation or other axial reorientation of the cans C. For example, a maze M of yarn as described may be immersed to progressively deeper levels in a series of different dye baths without any reorientation and this differing disposition due to immersion level change only will produce a varying color and color blending in unpredictably random nature when the yarn is contained in the above-described maze form. On the other hand advantageous unique processing and results may be obtained by the reorienting of the container as by segmental rotation whether or not the yarn is in the above-described maze condition.

Figure 12:
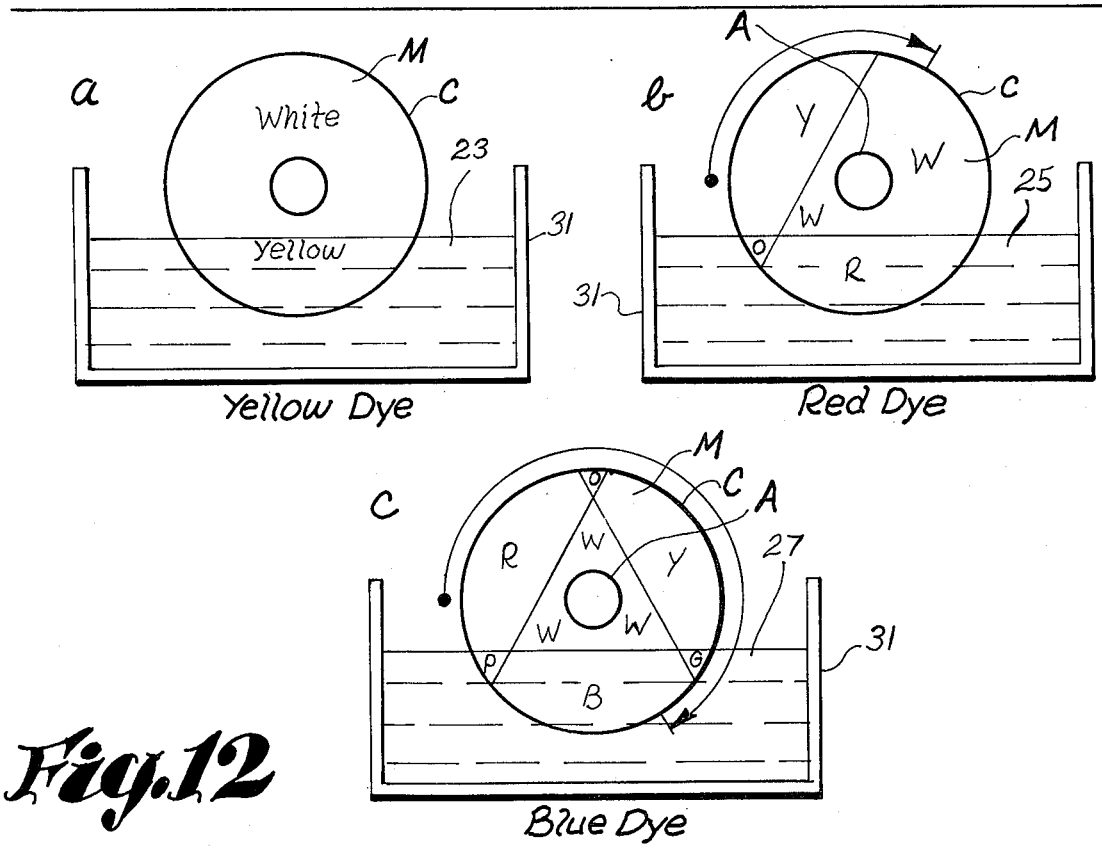
FIGS. 12 *a*, *b*, and *c* are diagrammatic illustrations of a variation of the dyeing immersion sequence of FIGS. 11 *a*, *b*, and *c*.

An example of can rotation with a less than axial level of immersion is illustrated in FIGS. 12 *a*, *b*, and *c* wherein the cans C are immersed to about one-third of their vertical extent and are rotated 120° between immersions. This results in a triangular center portion that is undyed or white (W) (but which could be a color to which the maze has been previously dyed by a full immersion dyeing procedure), truncated chordal portions of yellow (Y), red (R), and blue (B), and small triangular segments that have been subjected to dye in two of the baths to provide orange (O), green (G), and purple (P).

The yarn material used in practicing this invention may be of any of the usual dyeable types, such as bulked spun yarn, continuous filament unbulked yarn, spun unbulked synthetic yarn, natural fiber spun yarn as well as others; and any compatible type of dye can be used. Also, although the preferred embodiment is described in terms of dyeing, it is obvious that the invention is applicable to other treatments as well as dyeing is intended only as a primary example. In this sense dyeing is intended to encompass any type of treatment, such as applying dye-resist chemicals in different arrangements so that upon dyeing of a fabric made with the treated yarn an effect is obtained similar to that when the present invention is used with dyes. Moreover, the maze M or other form of yarn may be disposed through this process in containers other than cylindrical cans; cans of other shapes and even bags may be used provided the material of the containers is perforate to allow flow of dye and rinse fluid to the yarn therein.

Because of the disposition of the yarn in perforate cans C and the dye concentration in the forced flow system, the present invention is capable of high speed dyeing. A typical dye bath immersion requires only two minutes and the system has the capability of even lesser cycle times.

Depending on the type of dye and yarn and the length of time in movement between dye baths, it may be possible to omit the intermediate rinse baths and use only one or both of the two last rinse baths 28 and 29. Also, for desired effect, the can may be completely submerged in one of the dye baths or rotated one-half revolution between two dye baths containing identical dye for, in either case, full color dyeing before or after partial dyeing in the other dye baths.

Figure 7:
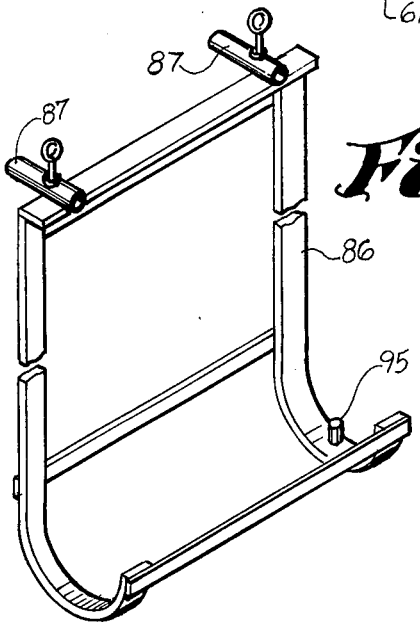
FIG. 7 is a perspective view of a can supporting cradle of the type used in raising and lowering a can into the dye bath in a variation of the dyeing line of FIG. 1.
Figure 10:
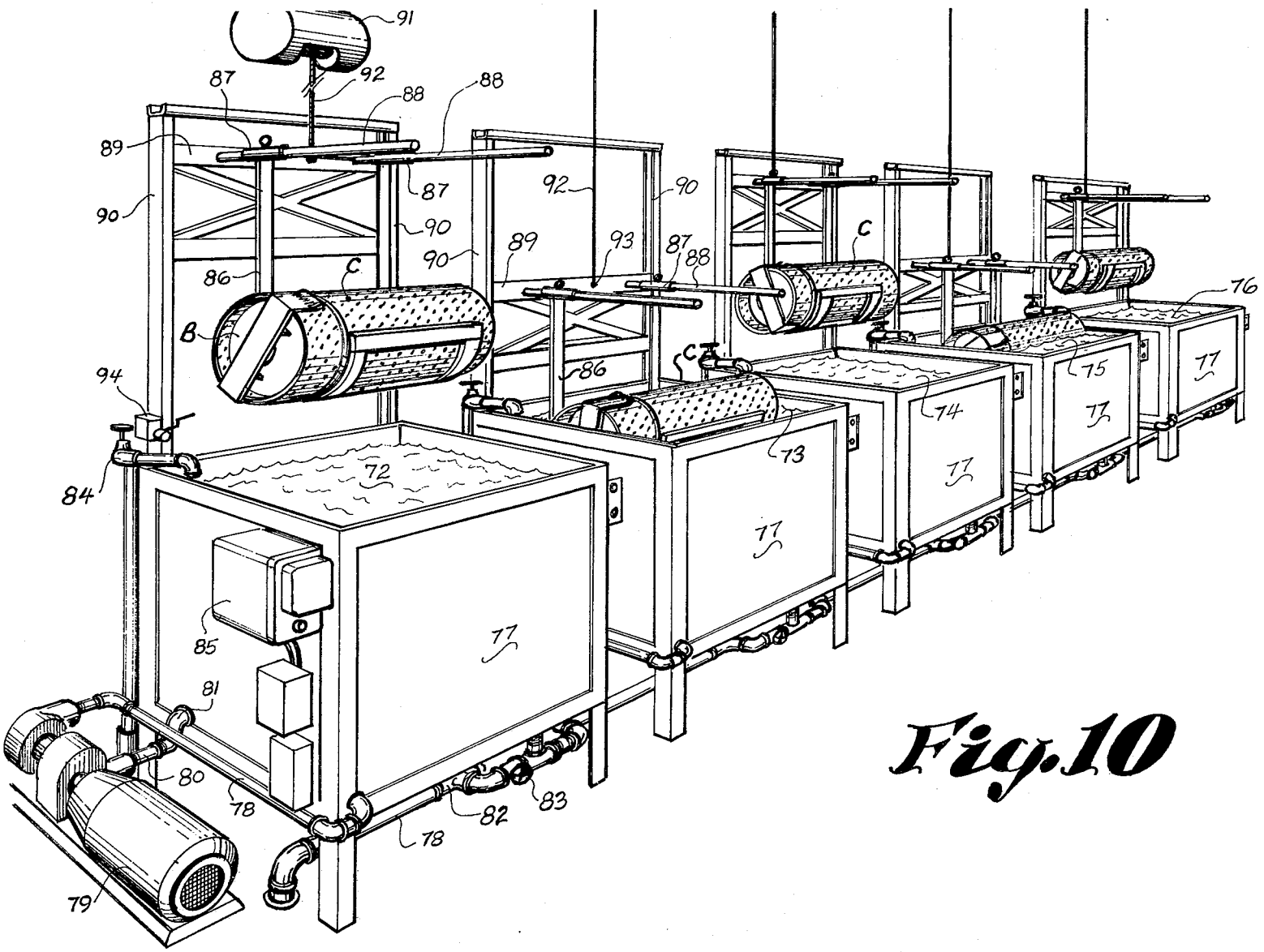
FIG. 10 is a perspective view of a variation of the dyeing line of FIG. 1.

A variation of the equipment used in practicing the present invention is disclosed in FIGS. 10, 7, and 8 in the form of a manually operable, unautomated arrangement capable of accomplishing the same functions and purposes as with the previously described construction. In this simplified form, a series of three similar dye baths 72, 73, and 74 are arranged in a row without rinse baths therebetween, but with two rinse baths 75 and 76 following the dye baths. Each tub 77 of the dye and rinse baths is similar to the above-described tubs 31 and is fitted with a recirculation drain pipe 78 that draws dye liquor or rinse water from the bottom of the tub 77 to a recirculating pump 79 from which the dye liquor or rinse water is recirculated to the tub 77 through an input pipe 80 that is connected to a tube 81 in the tub 77 similar to the above-described tubes 62. A drain pipe 82 is connected to the bottom of the tub 77 for emptying the tub 77 to a sewer line at the end of a dyeing run, for which purpose a valve 83 is located in the drain pipe 82. Makeup water is added to the tubs 77 through fill pipes 84 that feed into the top of the tubs 77. The dye liquor or rinse water is heated by steam coils (not shown) similar to the coil 65 described previously. Control of the pump operation as well as operation of the mechanism for immersing the cans C is accomplished through conventional control boxes 85 mounted on the sides of the tubs 77.

Rather than having a trolley system for automatically advancing cans from one bath to another, this embodiment has separate can mounting and manipulating mechanisms associated with each tub 77. This mechanism includes a J-shaped cradle 86 that is identical to half of the cradle 34 of the previously described embodiment and is similarly mounted by sleeves 87 thereon on support rods 88 that project from a vertically slideable frame 89 supported for vertical sliding movement in a pair of opposed upstanding channels 90 secured to and projecting upwardly from the rear of each tub 77. Raising and lowering of the slideable frame 89 in the channels 90 is accomplished by a hoist mechanism 91 mounted on the ceiling above the frame 89 and connected thereto through a cable 92 secured to the frame 89 at a projecting eye 93. Operation of the hoist mechanism 91 is controlled by the aforementioned control boxes 85 and upon lowering of the frame 89 it engages a limit switch 94 mounted adjacent the top of the tub 77 on one of the upstanding channels 90 in a position to be engaged by the frame 89 when the can C has been immersed to a desired level in the bath. This limit switch 94 is adjustable vertically to adjust the depth of immersion and functions to stop the hoist mechanism 91 at the desired frame location.

In the illustration of FIG. 10 alternate cans C are shown in a raised position with the other cans being shown in immersed positions. In practice all of the cans would normally be raised and lowered together, but for clarity and avoidance of duplication of illustration the cans C are shown in different positions in FIG. 10. In using the equipment illustrated in FIG. 10, a can C is manually placed in the J-shaped cradle 86 at the first dye bath 72 with its cylindrical axis horizontally disposed and it is positioned with respect to rotation about the cylindrical axis by engagement of an upstanding stud 95 in the bottom of the cradle in one of three holes 96 in the can C. These holes are spaced circumferentially 120° apart for reorienting the can to accomplish the segmental dyeing described in relation to FIG. 11 with the previously described form. The number and spacing of these holes 96 may be varied as desired to obtain any type of dyeing relationship. When a can C has been immersed in the first dye bath 72 and subsequently raised to the position shown in FIG. 10, it is manually removed and placed on the cradle 86 at the second dye bath 73 with a different hole 96 aligned with and receiving the stud 95 on the second cradle, thereby reorienting the can C about its axis to rotate it 120°. A similar manual operation is performed to transfer the can C from the second dye bath 73 to the third dye bath 74.

At the two rinse baths 75 and 76 the cans C are totally immersed for full rinsing and the two rinse baths are used in the line so that rinsing can take place during the time period of two dye immersions, thereby assuring proper rinsing of excess dye from the maze M of yarn in the can C. Preferably, of course, a full complement of cans are in process simultaneously so that cans C are being immersed in each of the dye baths and rinse baths at the same time.

A further advantage of the dyeing equipment of the embodiment of FIG. 10 is that the cradles 86 can be removed and the same equipment can otherwise be used for dyeing skeins of yarn by placing skeins over the support rods 88 and adding other support rods as necessary to position the skeins during dyeing, with the skeins being disposed in different dyeing dispositions in each of the dye baths by rotating the skeins a selected amount when placed on the support rods at the sequential dye baths and immersing half, or other selected portion, of each skein in each of the dye baths and also immersing half of each skein in each rinse bath to rinse the entire skeins. This type of skein dyeing, while utilizing the equipment of the embodiment of FIG. 10, does not, of course, result in the completely unpredictable random color distribution that characterizes the present invention otherwise. A modicum of randomness can be obtained with skeins by placing them lengthwise in the cans C used with the aforementioned yarn mazes M and then twisting the skeins in the cans so that they have a somewhat coiled disposition that crosses different dye segments.

The present invention is advantageously capable of further modifications and variations in apparent forms other than those described in detail herein and it is not intended that the detailed description and drawings that are provided for purposes only of illustration herein should limit in any way the scope of the present invention, except as the invention is defined in the accompanying claims.

I claim:

1. A method of multi-color dyeing textile yarn comprising progressively advancing a batch of textile yarn contained in a perforate container through the steps of positioning said container to have a horizontally disposed axis along which the yarn is disposed in an axially progressing tortuously coiled maze, immersing said positioned container sequentially in each of a plurality of dye baths with the immersion in at least one of two sequential dye baths of said plurality being to a depth less than the full extent of the batch of yarn in said container so as to have dye applied to only a portion of the batch in said at least one dye bath, while disposing the container in a different dyeing disposition in each of said two dye baths with said axis maintained horizontally disposed.

2. A method of multi-color dyeing textile yarn according to claim 1 and characterized further in that said perforate container is a cylindrical can in which the batch of textile yarn has been randomly coiled in a progression along the cylindrical axis of the can, and in positioning said can the cylindrical axis thereof is horizontally disposed.

3. A method of multi-color dyeing textile yarn comprising progressively advancing a plurality of batches of textile yarn in perforate containers in sequence through the steps of positioning said containers to have horizontally disposed axes along which the yarn is disposed in an axially progressing tortuously coiled maze, immersing said positioned containers sequentially in each of a plurality of dye baths with the immersion in at least one of two sequential dye baths of said plurality being to a depth less than the full extent of the batch of yarn in said containers so as to apply dye to only a portion of each batch in said at least one dye bath, while disposing the containers in different dyeing dispositions in each of said two dye baths with said axes maintained horizontally disposed, said steps being performed simultaneously on sequential containers.

4. A method of multi-color dyeing textile yarn according to claim 3 and characterized further by the steps of immersing said containers in rinse baths after each dye bath immersion.

5. A method of multi-color dyeing textile yarn according to claim 3 and characterized further by the step of immersing alternate containers in alternate rinse baths following immersion in the last of said dye baths with each rinse bath immersion continuing during the period of two dye bath immersions.

6. A method of multi-color dyeing textile yarn comprising progressively advancing a batch of textile yarn contained in a perforate container through the steps of positioning said container to have a horizontally disposed axis along which the yarn is disposed in an axially progressing tortuously coiled maze, immersing said positioned container sequentially in each of a plurality of dye baths with the immersion in at least two of three sequential dye baths of said plurality being to a depth less than the full extent of the batch of yarn in said container so as to have dye applied to only a portion of the batch in said at least two dye baths, while disposing the container in a different dyeing disposition in each of said three dye baths with said axis maintained horizontally disposed.

7. A method of multi-color dyeing textile yarn comprising progressively advancing a batch of textile yarn contained in a perforate container through the steps of positioning said container to have a horizontally disposed axis, immersing said positioned container sequentially in each of a plurality of dye baths with the immersion in two sequential dye baths of said plurality being to depths less than the full extent of the batch of yarn in said container so as to have dye applied to only a portion of the batch in each of said two dye baths, while reorienting said container about said horizontal axis between immersions in said two dye baths to cause dyeing of at least partially different portions of the batch in said two dye baths.

8. A method of multi-color dyeing textile yarn according to claim 7 and characterized further in that the yarn in said batch is randomly distributed in said container.

9. A method of multi-color dyeing textile yarn according to claim 8 and characterized further in that the yarn is disposed in said container in a maze of tortuously extending coils that randomly extend from one of said differently dyed portions into another.

10. A method of multi-color dyeing textile yarn according to claim 7 and characterized further in that said container is a cylindrical can in which said yarn is disposed in coils progressing axially within said can, and in said positioning said container the cylindrical axis of said can is horizontally disposed.

11. A method of multi-color dyeing textile yarn according to claim 10 and characterized further in that said horizontal axis of the can is the cylindrical axis thereof and reorienting said container is accomplished by rotating said can about its cylindrical axis.

12. A method of multi-color dyeing textile yarn comprising progressively advancing a batch of textile yarn contained in a perforate container through the steps of positioning said container to have a horizontally disposed axis, immersing said positioned container sequentially in each of a plurality of dye baths with the immersion in three sequential dye baths of said plurality being to depths less than the full extent of the batch of yarn in said container so as to have dye applied to only a portion of the batch in each of said three dye baths, while reorienting said container about said horizontal axis between immersions in said three dye baths to cause dyeing of at least partially different portions of the batch in said three dye baths.

13. A method of multi-color dyeing textile yarn according to claim 12 and characterized further in that in said reorienting said container between immersions in said three dye baths the container is rotated one third of a revolution between immersion in the first and second of the three dye baths and also one third of a revolution between immersion in the second and third dye baths.

14. A method of multi-color dyeing textile yarn according to claim 13 and characterized further in that in immersing said container in each of said three dye baths the container immersed to the level of the horizontal axis to provide with the aforesaid one third revolution reorienting a partial overlapping of dyeing that results in dividing of the batch into six differently dyed segments.

15. A method of multi-color dyeing textile yarn comprising progressively advancing a plurality of batches of textile yarn in perforate containers in sequence through the steps of positioning said containers to have horizontally disposed axes, immersing said positioned containers sequentially in each of a plurality of dye baths with the immersion in at least two sequential dye baths of said plurality being to depths less than the full extent of the batch of yarn in said containers so as to apply dye to only a portion of each batch in each of said at least two dye baths, while reorienting said containers about their horizontal axes between immersions in said at least two dye baths to cause dyeing of at least partially different portions of the batches in said at least two dye baths, said steps being performed simultaneously on sequential containers.

16. A method of multi-color dyeing textile yarn according to claim 15 and characterized further by the steps of immersing said containers in rinse baths after each dye bath immersion.

17. A method of multi-color dyeing textile yarn according to claim 15 and characterized further by the step of immersing alternate containers in alternate rinse baths following immersion in the last of said dye baths with each rinse bath immersion continuing during the period of two dye bath immersions.

18. Means for multi-color dyeing textile yarn comprising a plurality of dye baths, movable frame means for supporting a perforate cylindrical can containing textile yarn disposed in an axially progressing tortuously coiled maze with said frame means supporting said can with its cylindrical axis horizontally disposed, means for lowering and raising said frame means to immerse said supported can sequentially in said dye baths, said lowering and raising means being controlled to immerse the can in at least one of two sequential dye baths of said plurality to a depth less than the full extent of the yarn in said can so as to have dye applied to only a portion of the yarn in said at least one dye bath.

19. Means for multi-color dyeing textile yarn according to claim 18 and characterized further in that said movable frame means includes a J-shaped cradle on which said can is supported for immersion with its cylindrical axis horizontally disposed.

20. Means for multi-color dyeing textile yarn comprising a plurality of dye baths, movable frame means for supporting a perforate container of textile yarn with the frame means positioning said container to have a horizontally disposed axis, means for lowering and raising said frame means to immerse said supported container sequentially in said dye baths, said lowering and raising means being controlled to immerse the container in two sequential dye baths of said plurality to depths less than the full extent of the yarn in said container so as to have dye applied to only a portion of the yarn in each of said two baths, said frame means supporting said container in a manner to allow reorienting of said supported container about said horizontal axis between immersions in said two dye baths to cause dyeing of at least partially different portions of the yarn in said two dye baths.

21. Means for multi-color dyeing textile yarn according to claim 20 and characterized further in that said movable frame means includes a cradle on which said container is supported.

22. Means for multi-color dyeing textile yarn according to claim 20 and characterized further in that said container is a cylindrical can supported on said movable frame means with the cylindrical axis of the can horizontally disposed.

23. Means for multi-color dyeing textile yarn according to claim 22 and characterized further in that said movable frame means includes a J-shaped cradle on which said can is supported for immersion with its cylindrical axis horizontally disposed and on which said can is rotatable for reorienting about its cylindrical axis.

24. Means for multi-color dyeing textile yarn according to claim 23 and characterized further by means engageable with said can to rotate said can while it is supported in said cradle for reorientation thereof between immersion in said two dye baths.

25. Means for multi-color dyeing textile yarn according to claim 23 and characterized further by means for retaining said cylindrical can in reoriented position.

26. Means for multi-color dyeing textile yarn according to claim 25 and characterized further in that said retaining means comprises a stud projecting from said cradle and engageable in selected holes in said can to prevent rotation or axial movement thereof.

27. Means for multi-color dyeing textile yarn according to claim 20 and characterized further by means for reorienting said containers.

* * * * *